US005886330A

United States Patent [19]

Kang et al.

[11] Patent Number: 5,886,330

[45] Date of Patent: Mar. 23, 1999

[54] MICROWAVE OVEN HAVING FILTERED AIR EXHAUST PASSAGES

[75] Inventors: Jun-Hong Kang, Gunpo; Sun-Ki Kim, Suwon, both of Rep. of Korea

[73] Assignee: Samsung Electronics Co., Ltd, Suwon, Rep. of Korea

[21] Appl. No.: 935,084

[22] Filed: Sep. 26, 1997

[30] Foreign Application Priority Data

Mar. 22, 1997 [KR] Rep. of Korea ..... 1997 10015

[51] Int. Cl.[6] ..... H05B 6/80

[52] U.S. Cl. ..... 219/757; 126/21 A; 126/299 R; 454/236

[58] Field of Search ..... 219/757, 681, 219/400; 126/21 A, 299 R, 299 D, 273 R; 454/236

[56] References Cited

U.S. PATENT DOCUMENTS

| | | | |
|---|---|---|---|
| 3,859,901 | 1/1975 | White | 126/299 R |
| 3,952,640 | 4/1976 | Kuechler | 126/299 D |
| 4,072,487 | 2/1978 | Irwin | 454/151 |
| 4,140,479 | 2/1979 | Sirch et al. | 432/18 |
| 4,418,261 | 11/1983 | Jailor et al. | 219/757 |
| 4,790,863 | 12/1988 | Nobiraki et al. | 96/384 |

*Primary Examiner*—Philip H. Leung

*Attorney, Agent, or Firm*—Burns, Doane, Swecker & Mathis, L.L.P.

[57] ABSTRACT

An over-the-range microwave oven includes air intakes in its bottom wall and fans disposed at an upper portion of the oven for drawing air through respective intakes. The fans are mounted in respective cases, each of which forms an air inlet and an air outlet. Each air inlet communicates with a respective intake, and the air outlets communicate with a common duct leading to a discharge grill. Filters extend across respective ones of the air outlets and are of substantially the same size as the respective air outlets.

7 Claims, 5 Drawing Sheets

MICROWAVE OVEN HAVING FILTERED AIR EXHAUST PASSAGES

BACKGROUND OF THE INVENTION (1) Field of the Invention

The present invention relates to a microwave oven. More specially, it relates to an over-the-range microwave oven which has improved filters to filter odors generated during range cooking.

(2) Description of the Prior Art

An over-the-range microwave oven (hereinafter, microwave oven) is an oven that utilizes high frequency energy to cook food. It is positioned above a gas range for filtering range-cooking odor. A conventional microwave oven includes a main body 10, a cooking chamber 11, and an electrical component compartment provided to the inside of the main body 10, as shown in FIG. 4. The cooking chamber 11 is open at the front of the main body 10, and a door 13 is hinged on one side of the front of the main body 10 for opening and closing the cooking chamber. The electrical component compartment 12, installed at one side of the cooking chamber 11, includes a magnetron 12*a* for supplying microwave frequencies to the cooking chamber 11, and a high-voltage transformer 12*b* for supplying high voltage to the magnetron 12*a*. A control panel 14 is located at the front surface of the electrical component compartment 12 to control the cooking operation.

An air vent or intake 40 is positioned in the bottom of the main body 10 for the inflow of odor, smoke, etc. from foodstuffs being cooked by the gas range under the microwave oven. The indoor air begins the ventilation cycle through the air intake 40. This cycle filters bad air, smoke, odor, etc. so that filtered air re-enters and circulates inside the room. The conventional ventilator will be fully described referring to FIG. 5.

An upper duct 18 is located in the upper part of the main body 10 for conducting air that was filtered after being received via the air vents 40. A grill 20 is provided at the front of the upper part of the main body 10 to vent the filtered air out of the upper duct 18. A pair of duct cases 15, each having an air inlet 15*a* and an air outlet 15*b*, are installed in the rear of the upper duct 18. A fan 16 is housed in each of the duct cases 15. An electric motor 17 is positioned between the duct cases 15 and is connected to the fans 16, thus rotating the fans 16. The upper duct 18 also includes a filter 19 to filter air sent to the grill 20, and a pair of rails 21 for supporting the filter 19. Both ends of the filter 19 are respectively inserted into the rails 21, and the filter 19 is vertically installed in front of the fans 16 and the electric motor 17.

Once power is applied to the microwave oven, the high voltage transformer 12*b* increases the amplitude of voltage and furnishes it to the magnetron 12*a*. The magnetron 12*a* emits high frequency energy to the cooking chamber 1. The high frequency energy, produced by the magnetron 12*a*, cooks food in the cooking chamber 11. At the same time, as the ventilator goes into action, odor, smoke, etc. created from the range-cooking process are sucked in by the fans 16 through the air intake 40 formed on the bottom of the main body 10, and conducted via right and left paths (not illustrated) of the main body 10, and are sent to the filter 19 through the outlets 15*b* of the duct cases 15. The air is filtered by the filter 19 and reintroduced to the room through the grill 20.

The filter 19, spaced horizontally from the cases 15, must be sufficiently large to extend completely across the duct 18 in order to filter all of the air being discharged. It will be appreciated that the cost of the filter is proportional to its size.

SUMMARY OF THE INVENTION

The present invention is a microwave oven that can obviate the disadvantages of the conventional air filtering technique.

It is an objective of the present invention to provide a microwave oven that has filters that are reduced in size, corresponding to fan outlets, thereby lowering the manufacturing cost of the filters.

In order to attain the above-mentioned objective of the present invention, there is provided a microwave oven having: a main body, a cooking chamber provided in the main body, fans for circulating air through the body, cases encompassing respective fans, each case having an air inlet and an air outlet, and filters for filtering air, the filters being of the same size as the respective outlets, and extending across the respective outlets.

A pair of rails are preferably provided adjacent the respective outlets, into which the filters are removably inserted. The rails can extend vertically or horizontally.

DETAILED DESCRIPTION OF PREFERRED EMBODIMENTS

Preferred embodiments of the present invention will be described in detail with reference to the accompanying drawings.

Figure 1:
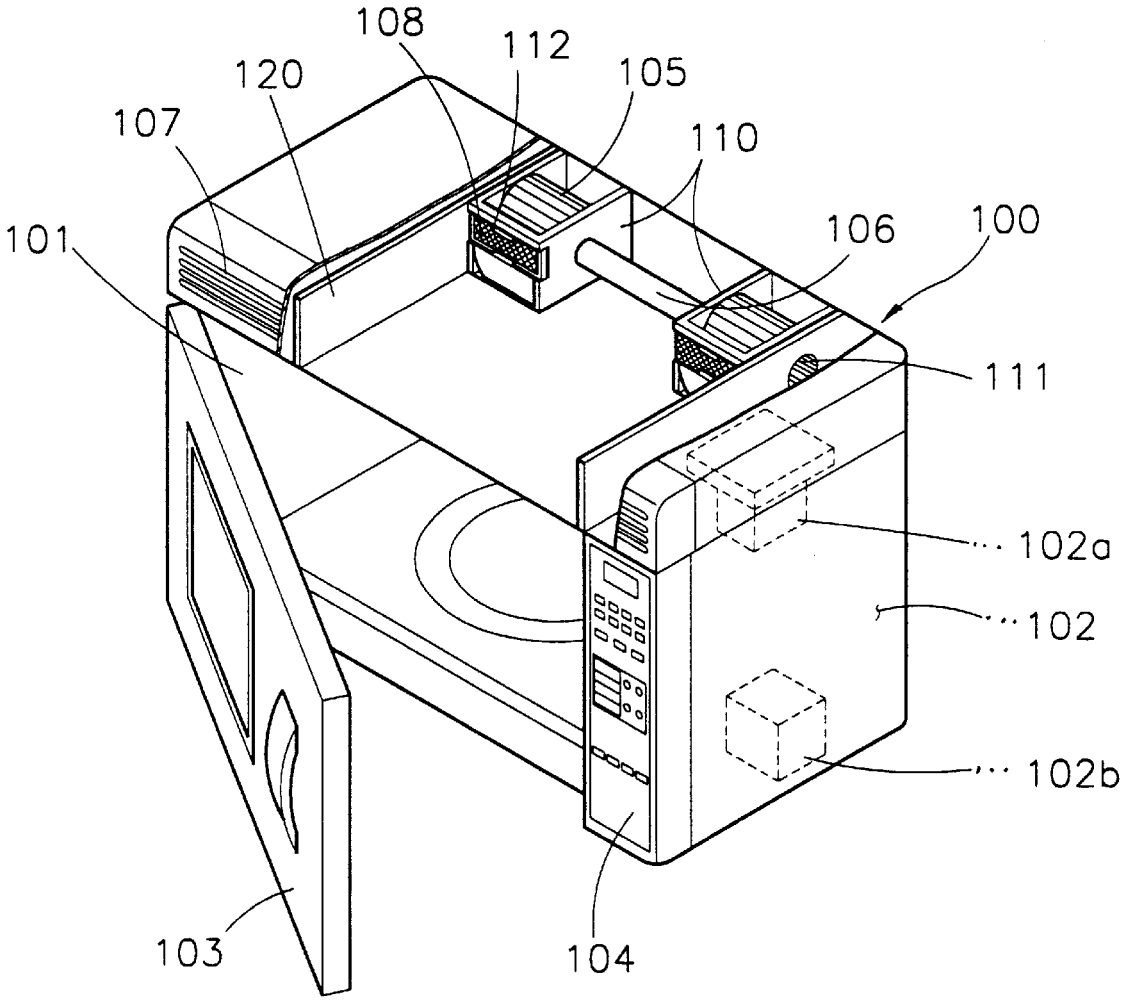
FIG. 1 is a cut-away top perspective view of a microwave oven in accordance with the present invention.

FIG. 1 is a cut-away perspective view of a microwave oven in accordance with the present invention. As shown in FIG. 1, a microwave oven of the present invention includes a main body 100, a cooking chamber 101, and an electrical component compartment 102 within the main body 100. A door 103 is provided at the front side of the cooking chamber 101 to open and close that chamber. The electrical component compartment 102 of the microwave oven includes a magnetron 102*a* for supplying high frequency energy to the cooking chamber 101, and a high voltage transformer 102*b* for supplying high voltage to the magnetron 102. A control panel 104 is provided on the front surface of the electrical component compartment 102 for controlling the microwave oven.

Once power is applied to the microwave oven of the present invention, high frequency energy is emitted to a foodstuff to be cooked inside of the cooking chamber 101 by the magnetron 102*a*, so the cooking operation is carried out according to a function selected by using the control panel 104.

The microwave oven also has a ventilator for filtering odor, smoke, etc. generated by the cooking process performed on a gas range and the like, disposed under the microwave oven, and for recirculating filtered air into the kitchen or room. Such a ventilator includes an upper duct 120 mounted on an upper exterior part of the cooking chamber 101, air flow paths (not illustrated) provided in respective sides of the main body 100 for guiding outside air received through the bottom of the main body 100, and a grill 107 installed in front of the upper duct 120 for venting air to the outside.

The ventilator also includes a pair of duct cases 110 each having an air inlet 111 and an air outlet 112 in the rear of the upper duct 120. A fan 105 is housed in each of the duct cases 110 for providing a flow of air, and a motor 106 is interposed between the duct cases 110 for rotating the fans 105 simultaneously. The upper duct 120 has filters 108 for filtering air before air is vented to the room through the grill 107.

Figure 2:
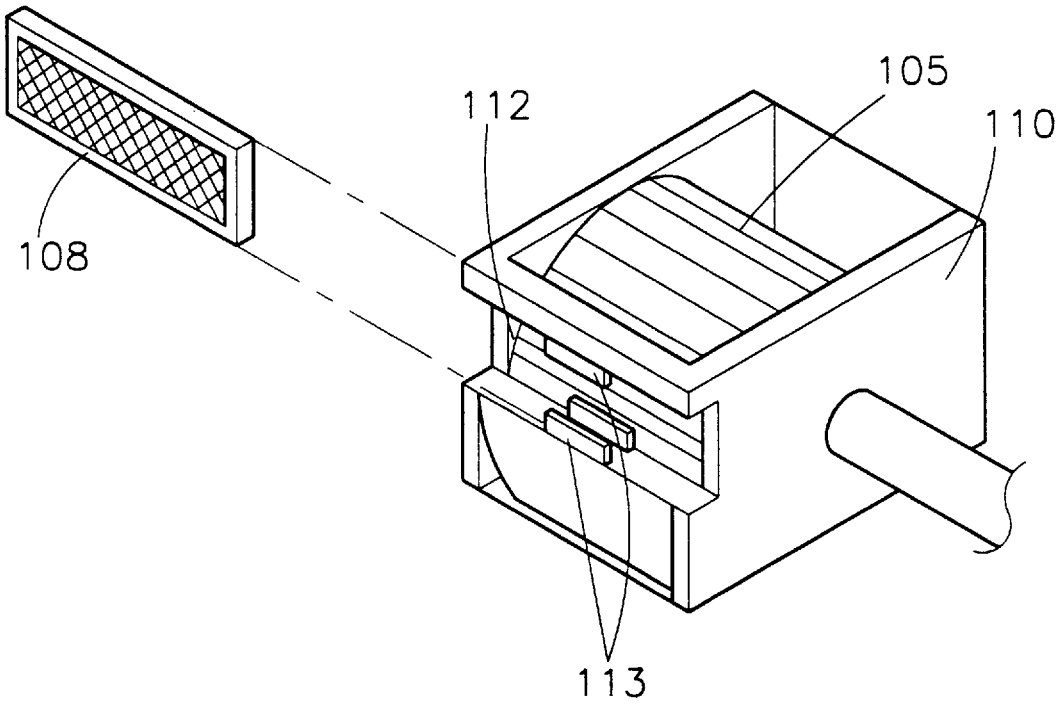
FIG. 2 is an enlarged exploded perspective view of a filter assembly for a microwave oven in accordance with a first preferred embodiment of the present invention.

As shown in FIG. 2, the filters 108 extend across respective outlets 112 of the duct cases 110, and are of the same size as each of the outlets 112. The filters are preferably identical to one another. A pair of horizontal rails 113 are each formed at upper and lower portions of the respective outlets 112 to form guides for the insertion of the filters 108. That is, the upper and lower edges of the filters 108 are inserted into respective rails 113 in a manner securing the filters 108 to the outlet 112.

Figure 3:
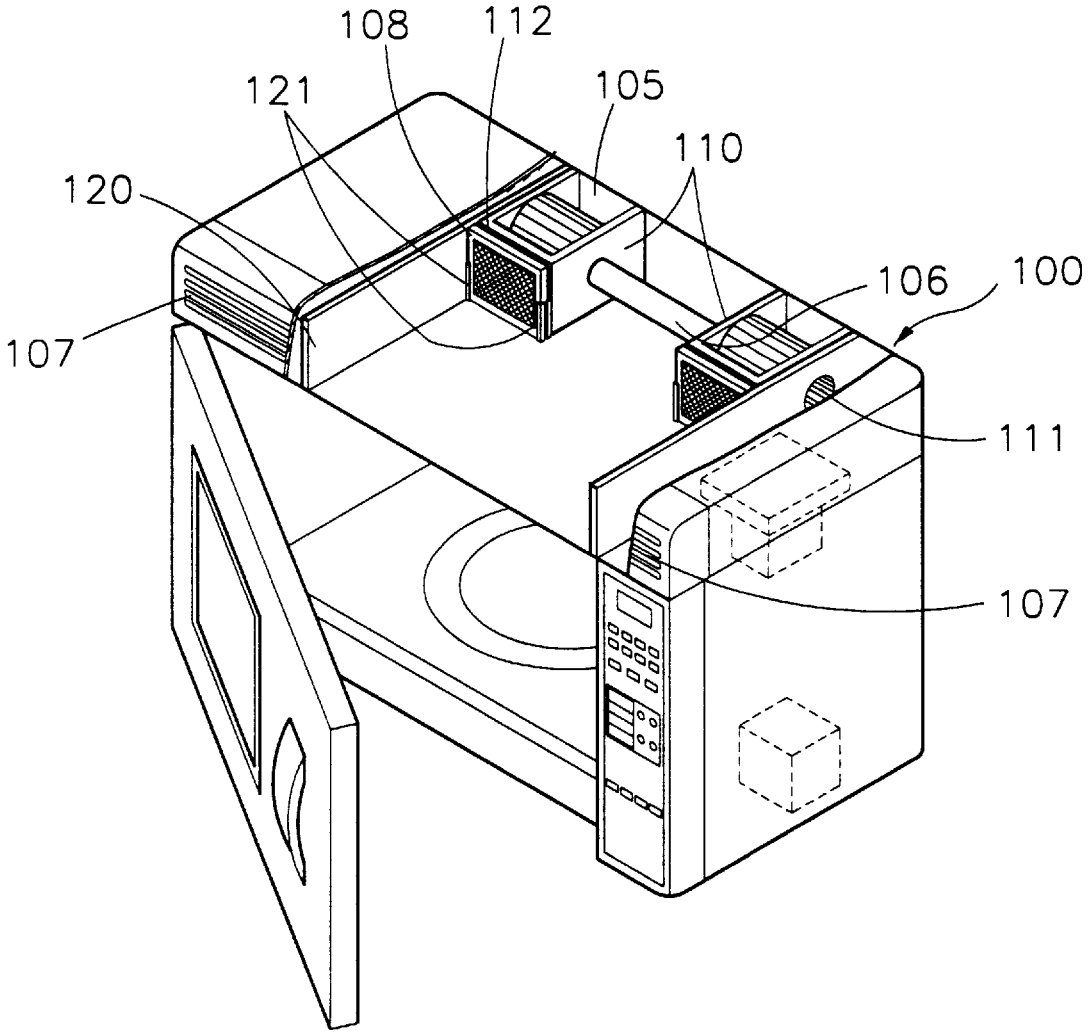
FIG. 3 is a cut-away top perspective view of a filter assembly for a microwave oven in accordance with a second preferred embodiment of the present invention.
Figure 4:
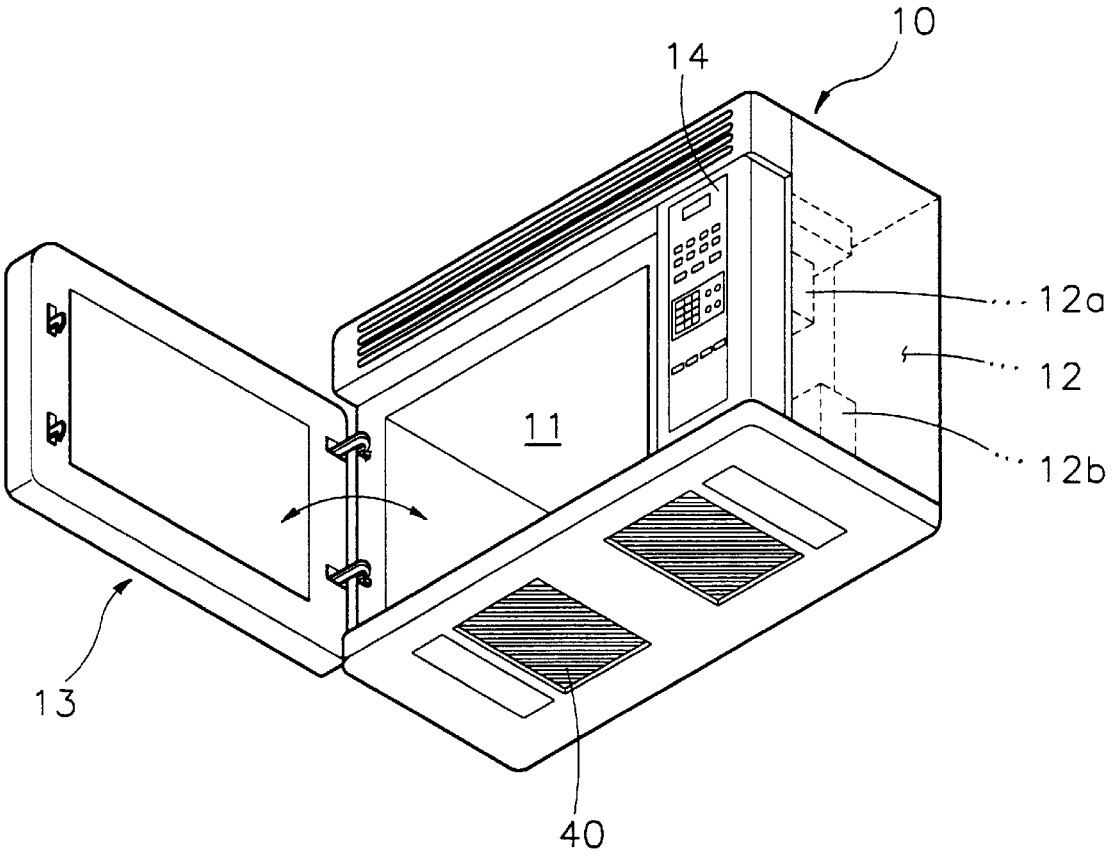
FIG.4 (PRIOR ART)
FIG. 4 is a bottom front perspective view of a conventional microwave oven.
Figure 5:
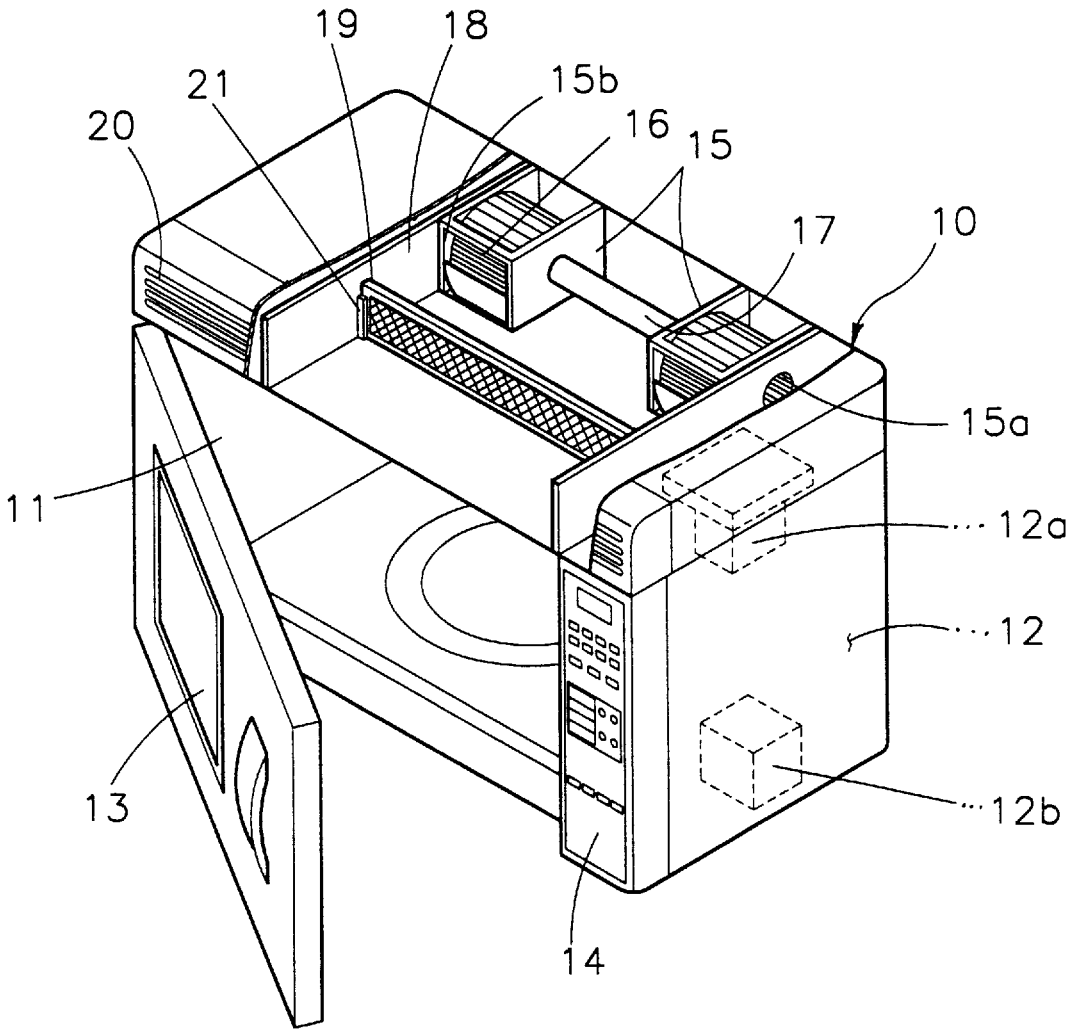
FIG.5 (PRIOR ART)
FIG. 5 is a cut-away top perspective view of the conventional microwave oven of FIG. 4.

FIG. 3 is a perspective view of a filter assembly for a microwave oven in accordance with a second preferred embodiment of the present invention. Similar reference numerals denote similar parts throughout the preferred embodiments of the present invention.

As shown in FIG. 3, a grill 107 is installed in front of the upper duct 120, formed on the upper part of the main body 100, for venting the filtered air to the outside. A pair of fans 105 are respectively installed in the duct cases 110 at the rear of the upper duct 120, and an electric motor 106 is provided between these fans 105 for rotating the fans 105. Each of the duct cases 110 has an inlet 111 and an outlet 112.

The upper duct 120 also includes filters 108 for filtering air to be sent through the outlets 112, and a pair of vertical rails 121 are formed for positioning these filters 108 against the front of the respective outlets 112. Opposite vertical edges of the filters 108 are inserted into respective rails 121 in a manner securing the filters 108 to the front of the outlets 112. In this second preferred embodiment of the present invention, each of the filters 108 is of the same size as that of the respective outlets 112; the filters are preferably identical to one another.

Each of the filters of the present invention is positioned at the outlets of the respective duct cases, and thus may be of the same size as those outlets.

Thus, the overall size of the air-filtering structure may be reduced, thereby lowering the overall production costs.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A microwave oven comprising:

a main body;

a cooking chamber disposed in said main body;

a magnetron for supplying microwaves to said cooking chamber;

fans each having a blade arrangement for circulating air through said body externally of said cooking chamber;

cases encompassing the blade arrangements of respective fans, each case forming an air inlet and an air outlet, whereby each fan has its own air inlet and air outlet;

said main body forming a common duct communicating with both of said air outlets for receiving and combining air flows from said air outlets and conducting said combined air flows outside of said main body; and filters extending across respective ones of said air outlets for filtering respective air flows prior to said air flows entering said common duct, and each filter being of substantially the same size as a respective air outlet.

2. The microwave oven as set forth in claim 1 wherein each case includes guide rails, each filter having opposing edges slidable along respective rails.

3. The microwave oven as set forth in claim 2 wherein said rails extend vertically.

4. The microwave oven according to claim 2 wherein said rails extend horizontally.

5. The microwave oven according to claim 1 wherein said filters are identical.

6. The microwave oven according to claim 1 wherein said main body forms air flow paths each having an air intake disposed in a bottom wall of said main body, and leading to a respective air inlet; said cases disposed at an upper portion of said main body.

7. The microwave oven according to claim 1 wherein said fans are spaced horizontally apart, and further including a single motor for driving both of said fans.

* * * * *